US011058245B2

(12) United States Patent
Wright et al.

(10) Patent No.: US 11,058,245 B2
(45) Date of Patent: Jul. 13, 2021

(54) CORNER WALL MOUNTABLE HANGING STRUCTURE

(71) Applicant: ELECTROLUX HOME PRODUCTS, INC., Charlotte, NC (US)

(72) Inventors: Erin Smith Wright, Indian Trail, NC (US); Brian Roderman, Plano, TX (US); David Singer, Austin, TX (US); Justin Pendleton, The Colony, TX (US); Sara Roueche Dulski, Huntersville, NC (US); Kevin Shin, Austin, TX (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 21 days.

(21) Appl. No.: 16/368,963

(22) Filed: Mar. 29, 2019

(65) Prior Publication Data

US 2019/0298091 A1 Oct. 3, 2019

Related U.S. Application Data

(60) Provisional application No. 62/650,804, filed on Mar. 30, 2018.

(51) Int. Cl.
*A47G 25/06* (2006.01)
*A47B 61/00* (2006.01)
(Continued)

(52) U.S. Cl.
CPC ..... *A47G 25/0692* (2013.01); *A47B 61/003* (2013.01); *A47F 5/00* (2013.01);
(Continued)

(58) Field of Classification Search
CPC .... A47H 2001/0205; A47H 1/02; A47H 1/10; A47H 1/14; A47H 1/142; A47H 1/04;
(Continued)

(56) References Cited

U.S. PATENT DOCUMENTS 438,109 A * 10/1890 Jones ..... A47H 1/142 248/264
546,832 A * 9/1895 Stevenson ..... A47H 1/022 211/105.2

(Continued)

*Primary Examiner* — Jonathan Liu
*Assistant Examiner* — Devin K Barnett
(74) *Attorney, Agent, or Firm* — Moore & Van Allen PLLC; Peter B. Stewart

(57) ABSTRACT

A mountable hanging structure may be mounted between two intersecting walls forming a corner. The hanging structure may comprise a rod comprising a body with a curved section extending between first and second ends and a mounting assembly comprising two retainers. Each of the retainers may comprises (1) a base configured for mounting to one of the intersecting walls, (2) a flange extending from the base for receiving a respective end of the rod, wherein the flange comprises one or more holding elements configured to receive the ends of the rod and prevent the rod from rotating relative to the base, and (3) a shroud configured for connecting to the base and comprising a bore for receiving an end of the rod. The base and the shroud may comprise interlocking members for interlocking the shroud to the base to mount the rod.

11 Claims, 12 Drawing Sheets

(51) Int. Cl.

| | |
|---|---|
| *A47H 1/04* | (2006.01) |
| *A47H 1/02* | (2006.01) |
| *A47K 10/04* | (2006.01) |
| *A47K 10/10* | (2006.01) |
| *A47F 5/00* | (2006.01) |
| *A47F 5/08* | (2006.01) |

(52) U.S. Cl.
CPC ..... *A47F 5/08* (2013.01); *A47H 1/02* (2013.01); *A47H 1/04* (2013.01); *A47H 2001/0205* (2013.01); *A47K 10/04* (2013.01); *A47K 10/10* (2013.01)

(58) Field of Classification Search
CPC .. A47G 25/0692; A47B 61/003; A47K 10/04; A47K 10/10; A47F 5/00; A47F 5/08
USPC ..... 211/105.1, 105.3–105.6; 248/220.1, 248/224.7, 220.21, 251, 200.1, 201, 261, 248/262, 264
See application file for complete search history.

(56) References Cited

U.S. PATENT DOCUMENTS

| | | | | | |
|---|---|---|---|---|---|
| 814,811 | A | | 3/1906 | Speed | |
| 1,019,662 | A | * | 3/1912 | Kroder | A47H 1/022 211/105.2 |
| 1,345,170 | A | * | 6/1920 | Gross | A47H 1/022 211/105.2 |
| 1,374,026 | A | * | 4/1921 | Nelson | A47H 1/102 211/105.4 |
| 1,529,740 | A | * | 3/1925 | Henry | A47H 1/102 211/105.2 |
| 1,566,882 | A | * | 12/1925 | Kirsch | A47H 1/142 248/262 |
| 1,778,611 | A | * | 10/1930 | Sprigg | A47K 10/10 248/224.8 |
| D116,604 | S | | 9/1939 | Hefferan | |
| 2,323,112 | A | * | 6/1943 | Birnie | A47H 1/022 160/21 |
| 2,498,590 | A | * | 2/1950 | Straus | E06B 9/50 248/264 |
| 2,653,344 | A | * | 9/1953 | Graber | A47H 5/032 16/94 D |
| 2,890,799 | A | * | 6/1959 | Rosenbaum | A47H 1/08 211/105.2 |
| 3,013,604 | A | * | 12/1961 | Roberts | A47H 15/00 160/344 |
| 3,602,286 | A | * | 8/1971 | Hachtel | A47H 5/032 160/344 |
| 4,493,423 | A | | 1/1985 | Kaeslin et al. | |
| 4,935,988 | A | * | 6/1990 | Ford | A47H 1/02 16/87.4 R |
| 4,961,296 | A | * | 10/1990 | Morehouse | A47H 1/102 160/330 |
| 4,979,713 | A | * | 12/1990 | Bell | A47K 10/10 248/221.11 |
| 5,039,049 | A | * | 8/1991 | Niemi | A47H 1/022 160/39 |
| 5,050,252 | A | | 9/1991 | Cuttriss | |
| 5,076,523 | A | * | 12/1991 | Wang | A47K 10/10 248/222.14 |
| 5,193,786 | A | | 3/1993 | Guenther | |
| 5,848,628 | A | * | 12/1998 | Badalamenti | A47H 1/02 160/38 |
| 6,260,600 | B1 | * | 7/2001 | Miller | A47H 1/08 160/19 |
| 7,243,806 | B2 | | 7/2007 | Kwok | |
| 7,823,845 | B2 | | 11/2010 | Fontana et al. | |
| D635,809 | S | | 4/2011 | OBrien et al. | |
| D639,409 | S | | 6/2011 | Gilbert | |
| D646,767 | S | | 10/2011 | Gilbert | |
| 8,069,508 | B2 | * | 12/2011 | O'Connell | A47K 3/38 211/105.1 |
| 8,166,583 | B1 | * | 5/2012 | Liang | A47K 3/38 211/105.2 |
| D664,023 | S | | 7/2012 | Gilbert | |
| 8,215,042 | B1 | | 7/2012 | Kilmer | |
| 8,382,051 | B2 | * | 2/2013 | Smith | A47K 10/10 211/105.1 |
| 8,453,982 | B2 | | 6/2013 | Baruch | |
| 8,528,753 | B2 | * | 9/2013 | Woolley, II | A47K 3/38 211/105.2 |
| 8,800,072 | B2 | * | 8/2014 | Chang | A47K 3/38 160/333 |
| 8,839,980 | B2 | | 9/2014 | Baines | |
| 9,874,309 | B2 | | 1/2018 | Sisto | |
| 10,051,985 | B2 | * | 8/2018 | Jones | A47H 1/142 |
| 10,248,153 | B2 | * | 4/2019 | Stoufer | G05G 5/05 |
| 10,606,302 | B2 | * | 3/2020 | Stoufer | F24C 7/08 |
| 2002/0104946 | A1 | * | 8/2002 | Lai | A47K 10/04 248/316.8 |
| 2004/0256338 | A1 | * | 12/2004 | McGarry | A47F 5/0838 211/94.01 |
| 2007/0169260 | A1 | * | 7/2007 | Huang | A47K 3/38 4/558 |
| 2007/0235612 | A1 | * | 10/2007 | Isfeld | A47B 61/003 248/251 |
| 2012/0074085 | A1 | * | 3/2012 | Chang | A47H 1/142 211/105.3 |
| 2013/0200024 | A1 | * | 8/2013 | Lindo | A47H 1/102 211/105.3 |
| 2013/0292349 | A1 | * | 11/2013 | Bucklew | A47K 3/38 211/105.2 |
| 2014/0131299 | A1 | * | 5/2014 | Didehvar | A47K 3/38 211/105.2 |
| 2014/0345814 | A1 | * | 11/2014 | Bar-lev | A47H 1/02 160/333 |
| 2015/0034581 | A1 | * | 2/2015 | Hsu | A47H 1/122 211/105.3 |
| 2015/0208878 | A1 | * | 7/2015 | Fazio | A47K 10/10 211/105.2 |

* cited by examiner

CORNER WALL MOUNTABLE HANGING STRUCTURE

CROSS-REFERENCE TO PRIORITY APPLICATION

This application claims priority to and the benefit of U.S. Provisional Patent Application Ser. No. 62/650,804 entitled "Corner Wall Mountable Hanging Structure" filed on Mar. 30, 2018, which is hereby incorporated by reference in its entirety.

FIELD OF THE INVENTION

The present invention relates to a mountable hanging structure for connection between two intersecting walls. In particular, the mountable hanging structure is structured for supporting hanger bars used for hanging articles of clothing.

BACKGROUND

Garments are typically placed on hangers, and such hangers may be hung on various structures. That said, there exists a need for an improved structure upon which hangers may be hung.

BRIEF SUMMARY OF THE INVENTION

The following presents a simplified summary of one or more embodiments of the invention in order to provide a basic understanding of such embodiments. This summary is not an extensive overview of all contemplated embodiments, and is intended to neither identify key or critical elements of all embodiments, nor delineate the scope of any or all embodiments. Its sole purpose is to present some concepts of one or more embodiments in a simplified form as a prelude to the more detailed description that is presented later.

The invention provides apparatuses and methods for mounting a hanging structure for connection between two intersecting walls forming a corner. In one exemplary embodiment, a hanging structure comprises a rod comprising a body with a curved section extending between first and second ends, wherein each of the first and second ends of the rod comprises one or more holes or notches in the body of the rod, a mounting assembly comprising two retainers, each retainer comprising at least a base configured for mounting to one of the intersecting walls and a flange extending from the base for receiving a respective end of the rod, wherein the flange comprises one or more holding elements configured to engage the one or more holes or notches in the body of the rod.

In some particular embodiments, the flange comprises a plate extending substantially perpendicular from a side of the base.

In some particular embodiments, the plate is circular.

In some particular embodiments, the plate is semicircular.

In some particular embodiments, the plate further comprises one or more through holes located on the opposing sides of the plate.

In some particular embodiments, the one or more holding elements comprises a pin, wherein the pin passes through the one or more through holes and the holes or notches in the ends of the rod to thereby at least prevent the rod from rotating relative to the base a hole.

In some particular embodiments, each of the retainers of the mounting assembly further comprises an intermediate gasket structured to abut the flange and ends of the pin to thereby hold the pin in position.

In some particular embodiments, each of the retainers of the mounting assembly further comprises a set of blocks structured to abut the flange and ends of the pin to thereby hold the pin in position.

In some particular embodiments, the one or more holding elements comprise at least two projections extending inwardly from the plate. The at least two projections of the plate may be configured to fit in the one or more holes or notches in the ends of the rod to thereby at least prevent the rod from rotating relative to the base.

In some particular embodiments, each of the retainers of the mounting assembly further comprises a shroud configured for connecting to the base and comprising a bore for receiving an end of the rod.

In some particular embodiments, the base and the shroud comprise interlocking members for interlocking the shroud to the base thereby mounting the rod.

In some particular embodiments, the curved section of the rod has a radius of curvature of between about 250 millimeters and 400 millimeters.

In some particular embodiments, the curved section of the rod has a radius of curvature of between about 300 millimeters and 350 millimeters.

In another exemplary embodiment, a hanging structure comprises a rod comprising a body with a curved section extending between first and second ends, wherein each of the first and second ends of the rod comprises one or more holes or notches in the body of the rod, a mounting assembly comprising two retainers, each retainer comprising at least a base configured for mounting to one of the intersecting walls, a flange extending from the base for receiving a respective end of the rod, wherein the flange comprises a circular plate extending substantially perpendicular from a side of the base, wherein the plate comprises first and second projections extending inwardly from the plate configured to engage the one or more holes or notches in the body of the rod, and a shroud comprising a bore for receiving an end of the rod, wherein the shroud is configured to engage with the base to mount the rod.

In some particular embodiments, the first projection and the second projection are located on opposing sides of the plate.

In some particular embodiments, the curved section of the rod has a radius of curvature of between about 250 millimeters and 400 millimeters.

In some particular embodiments, the curved section of the rod has a radius of curvature of between about 300 millimeters and 350 millimeters.

The features, functions, and advantages that have been discussed may be achieved independently in various embodiments of the present invention or may be combined with yet other embodiments, further details of which can be seen with reference to the following description and drawings.

BRIEF DESCRIPTION OF THE DRAWINGS

The features and functions of the invention, and the manner in which the same are accomplished, will become more readily apparent upon consideration of the following detailed description of the invention taken in conjunction with the accompanying drawings, which illustrate typical and exemplary embodiments and which are not necessarily drawn to scale, wherein.

DETAILED DESCRIPTION OF THE INVENTION

The present invention now will be described more fully hereinafter with reference to the accompanying drawings, in which some, but not all embodiments of the invention are shown. This invention may be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

The present invention provides a hanging structure specifically designed for providing a resting place for the hangers at the location of two intersecting walls.

Figure 1:
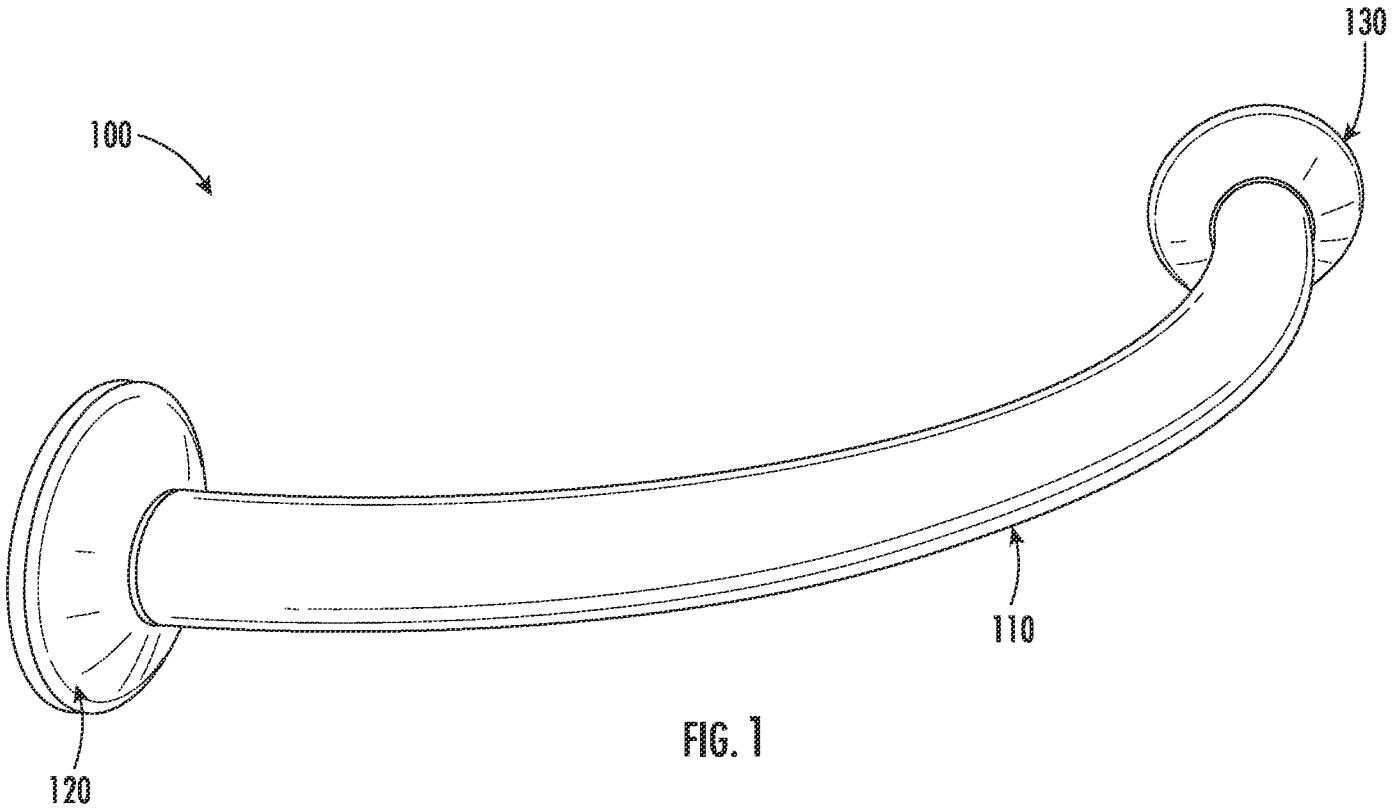
FIG. 1 illustrates a perspective view 100 of a corner wall mountable hanging structure, in accordance with some embodiments of the invention.

In this regard, FIG. 1 illustrates a perspective view 100 of a corner wall mountable hanging structure, in accordance with some embodiments of the present invention. The corner wall mountable hanging structure typically comprises a rod 110 and a mounting assembly comprising two retainers 120 and 130. The rod 110 typically comprises a body with a curved section extending between first and second ends and is structured to support hanger bars used for hanging articles of clothing. The rod 110 may have variable length and/or variable radius of curvature for different angles between the intersecting walls. In one embodiment, where the angle between the intersecting walls is 90 degrees, a rod with a radius of curvature of between about 250 millimeters and 400 millimeters, such as between about 300 millimeters and 350 millimeters, may be used. In some embodiments, the rod has a radius of curvature of between about 310 millimeters and 330 millimeters (e.g., 316.80 millimeters). In one embodiment, the diameter of the rod 110 is 32 millimeters. The retainers 120 and 130 mount the rod 110 to two intersecting walls. An exemplary configuration of two retainers 120 and 130 is illustrated from FIG. 3 through FIG. 7. Another exemplary configuration of the two retainers 120 and 130 is illustrated from FIG. 8 through FIG. 10. It will be appreciate that although the first retainer 120 is depicted in FIGS. 3-7 and 8-10, the second retainer 130 may have the same configuration as the illustrated first retainer 120.

Figure 2:
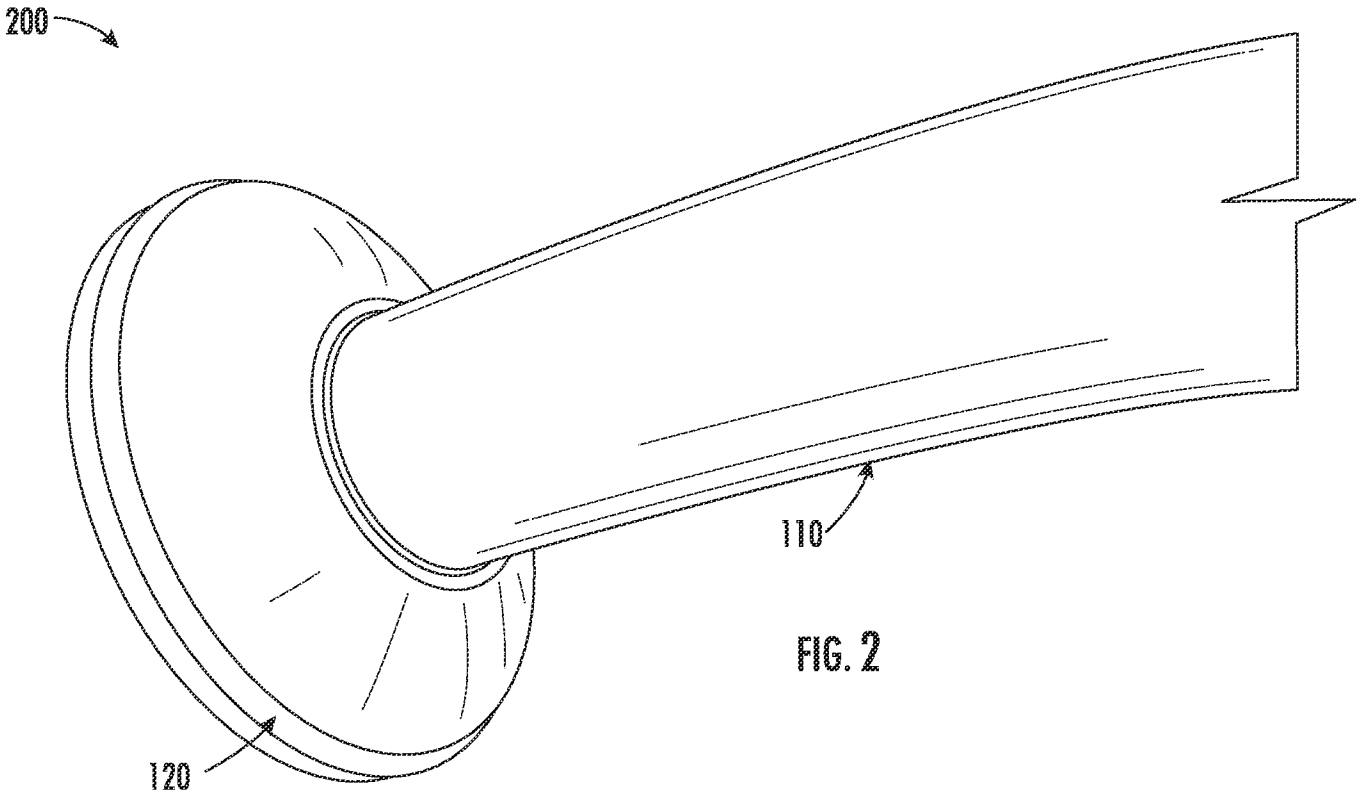
FIG. 2 illustrates a perspective view 200 of a retainer of the corner wall mountable hanging structure illustrated in FIG. 1, in accordance with some embodiments of the invention.

FIG. 2 illustrates a perspective view 200 of the retainer 120 of the corner wall mountable hanging structure illustrated in FIG. 1, in accordance with some embodiments of the present invention. The retainer 120, as shown is configured to retain the first end of the rod 110. Similarly, the retainer 130 is configured to retain the second end of the rod 110.

Figure 3:
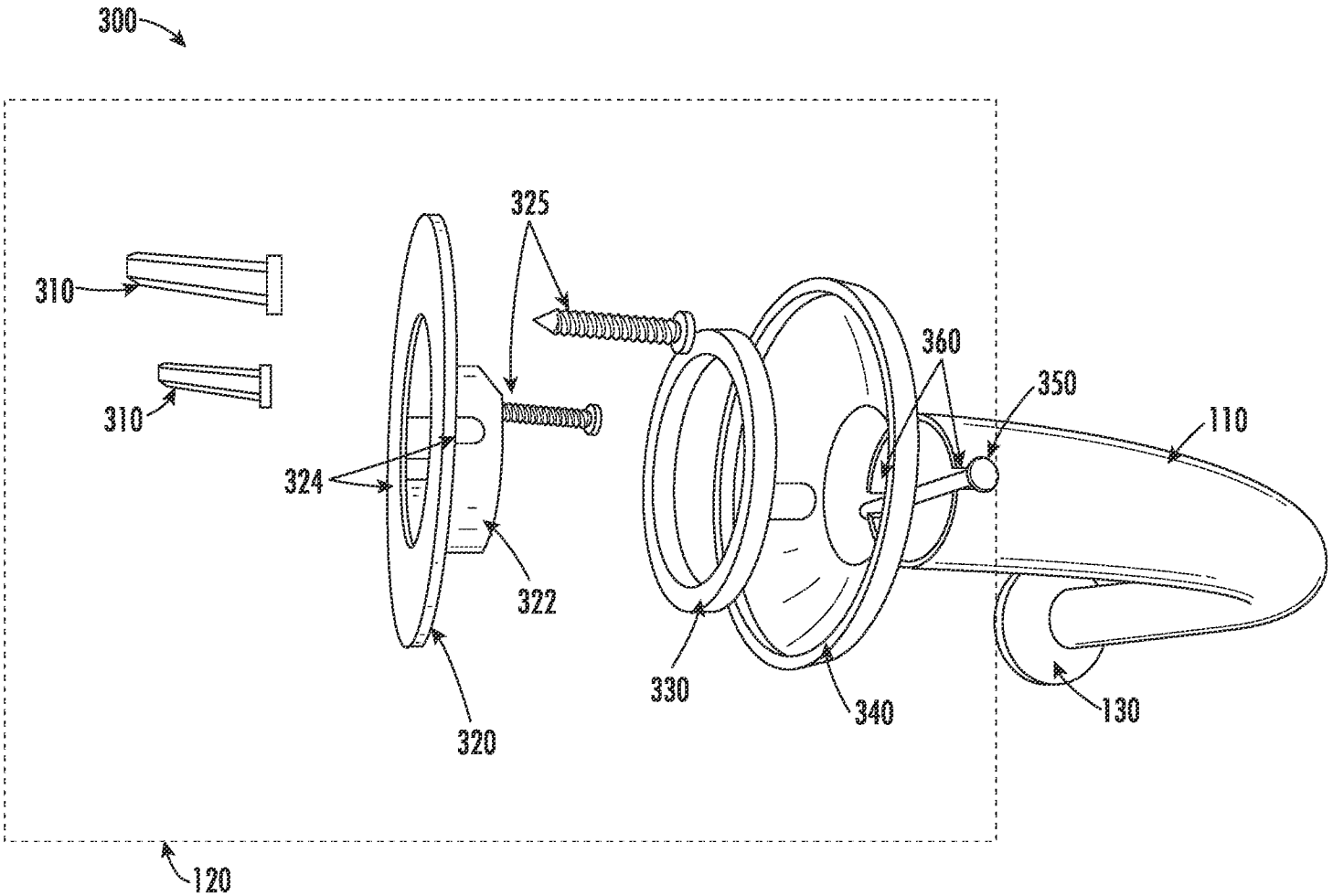
FIG. 3 illustrates a perspective exploded view 300 of a configuration of the retainer illustrated in FIG. 2, in accordance with some embodiments of the invention.
Figure 5A:
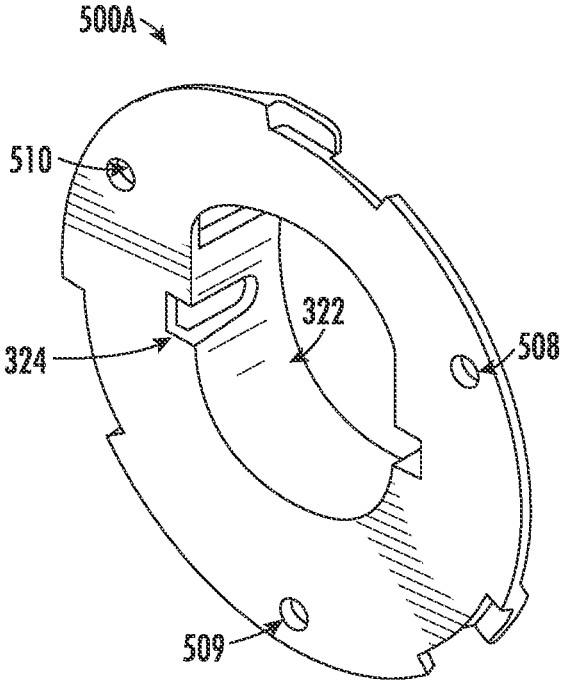
FIG. 5A illustrates a perspective view 500A of a base of the retainer illustrated in FIG. 3 and FIG. 4, in accordance with some embodiments of the invention.
Figure 5B:
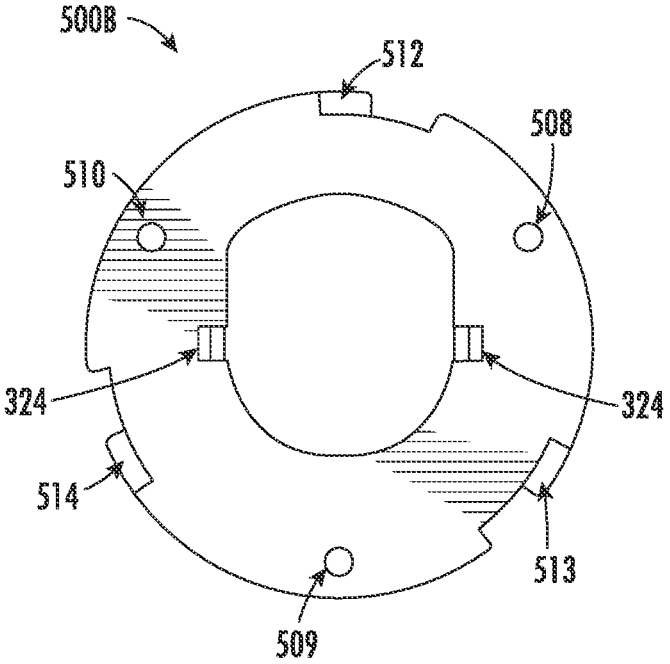
FIG. 5B illustrates a back side view 500B of the base of the retainer illustrated in FIG. 5A, in accordance with some embodiments of the invention.
Figure 5C:
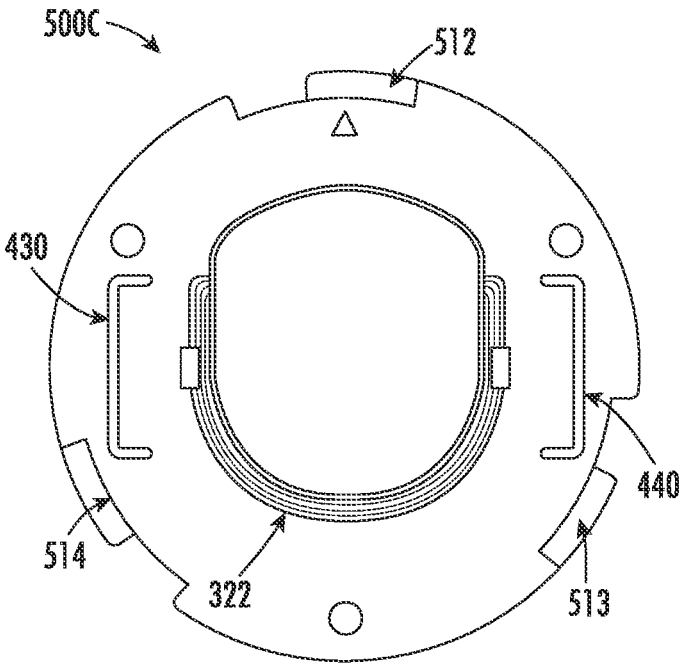
FIG. 5C illustrates a front side view 500C of the base of the retainer illustrated in FIG. 5A, in accordance with some embodiments of the invention.
Figure 9A:
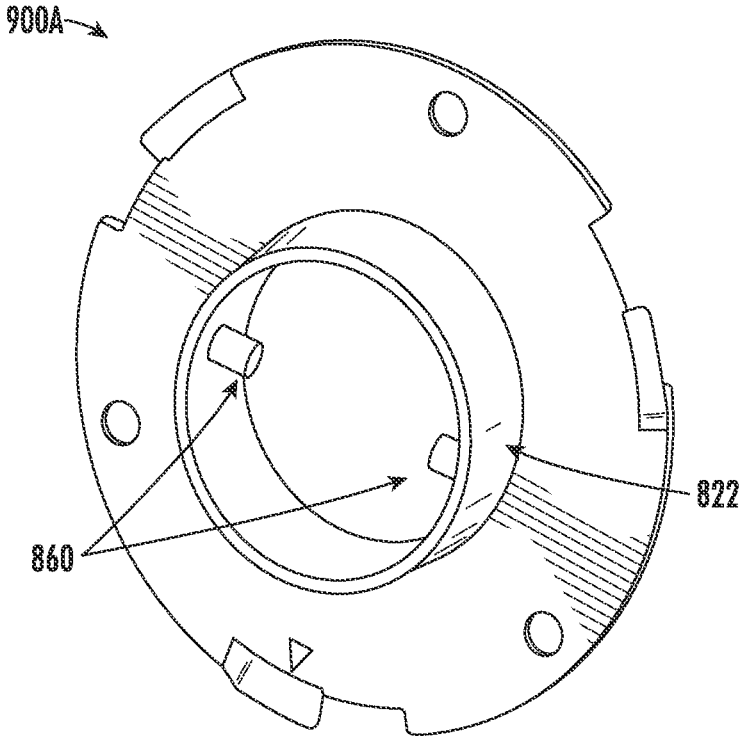
FIG. 9A illustrates a perspective view 900A of a base of the retainer illustrated in FIG. 8, in accordance with some embodiments of the invention.
Figure 9B:
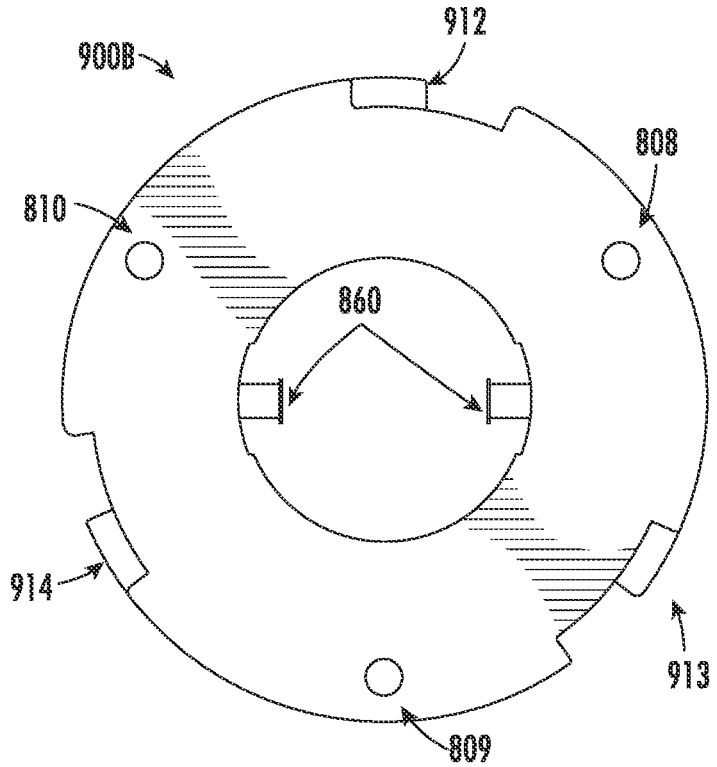
FIG. 9B illustrates a back side view 900B of the base of the retainer illustrated in FIG. 9A, in accordance with some embodiments of the invention.
Figure 9C:
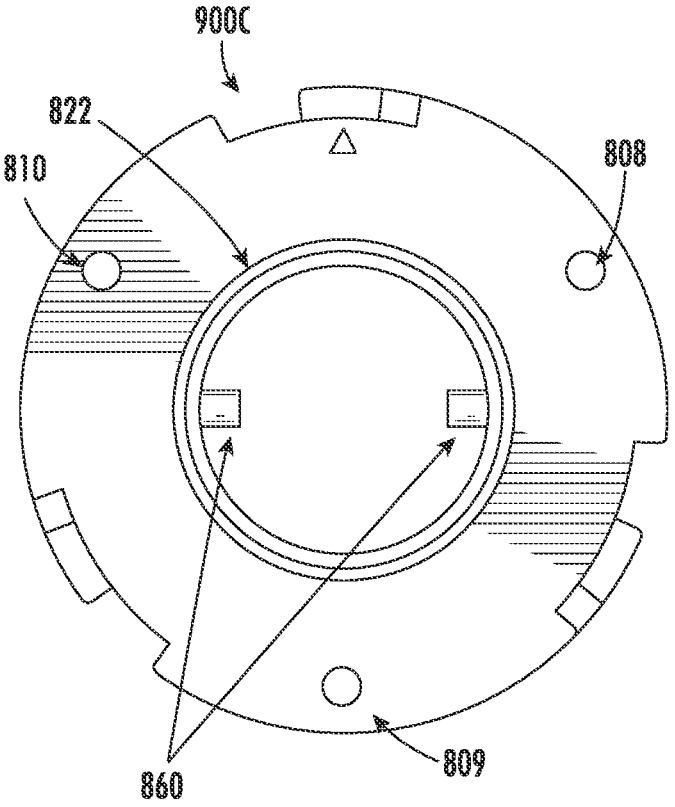
FIG. 9C illustrates a front side view 900C of the base of the retainer illustrated in FIG. 9A, in accordance with some embodiments of the invention.

FIG. 3 illustrates a perspective exploded view 300 of a configuration of the retainer 120, in accordance with some embodiments of the present invention. The retainer 120 comprises a base 320 for mounting to one of the intersecting walls. In some embodiments, the base 320 includes a ring, where the outer circumference of the ring is circular and the inner circumference of the ring is non-circular (as illustrated in FIGS. 5A-5C). In some embodiments, the base 320 includes a ring, where the outer circumference and the inner circumference of the ring are circular (as illustrated in FIGS. 9A-9C). In some embodiments, the outer circumference of the ring may be in the form of any geometric or non-geometric shape with the same inner circumference of the ring as illustrated in FIGS. 5A-5C. In some other embodiments, the base 320 may include a disk comprising the features and elements as described herein. The base 320 is mounted to one of the intersecting walls using any appropriate fastening element. In one embodiment of the present invention, the base 320 is mounted to the wall using fasteners 325 (e.g., screws) and anchors 310 as shown in FIG. 3. As shown, a flange 322 typically extends from the base 320 for receiving a respective end of the rod. In some embodiments, the flange 322 comprises a semicircular plate extending substantially perpendicular from a side of the base and two through holes 324 on the ends of the semicircular plate. The inner diameter of the semicircular plate is typically slightly greater than the outer diameter of the rod 110.

The retainer may comprise a holding member to hold the rod 110. As shown in FIG. 3, in one embodiment, the holding member is a pin 350 used for mounting the rod 110 to the base 320. For mounting the rod 110 to the base 320, in one embodiment, the rod 110 typically comprises a set of holes or notches 360 in the ends of the rod 110. In another embodiment of the present invention, the rod 110 comprises a set of holes in the ends of the rod 110. The pin 350 passes through the holes 324 in the flange 322 and the holes or notches 360 in the ends of the rod 110 to mount the rod 110 to the base 320 and also to prevent the rod 110 from rotating relative to the base 320. The base 320 comprises at least one intermediate gasket 330 for holding the pin 350 in position and to prevent it from slipping. In some embodiments, the intermediate gasket 330 may be permanently attached to the base 320. As depicted in FIG. 3, the at least one intermediate gasket 330 may defined a ring-like shape such that the inner diameter of the intermediate gasket 330 is greater the outer diameter of the semicircular plate of the flange 322. The base 320 may further include at least one circular protrusion (not shown) extending radially outward from the base 320 for holding the intermediate gasket 330 in position. The at least one circular protrusion may be designed to match the shape of the intermediate gasket 330 and may have an inner diameter which is equal to or slightly greater than the outer diameter of the intermediate gasket 330. In some embodiments, the circular protrusion extending from the base may not be continuous. The retainer also comprises a shroud 340 which covers the base 320 and is configured for connection to one of the bases. The shroud 340 also comprises a bore for receiving an end of the rod 110.

Figure 4:
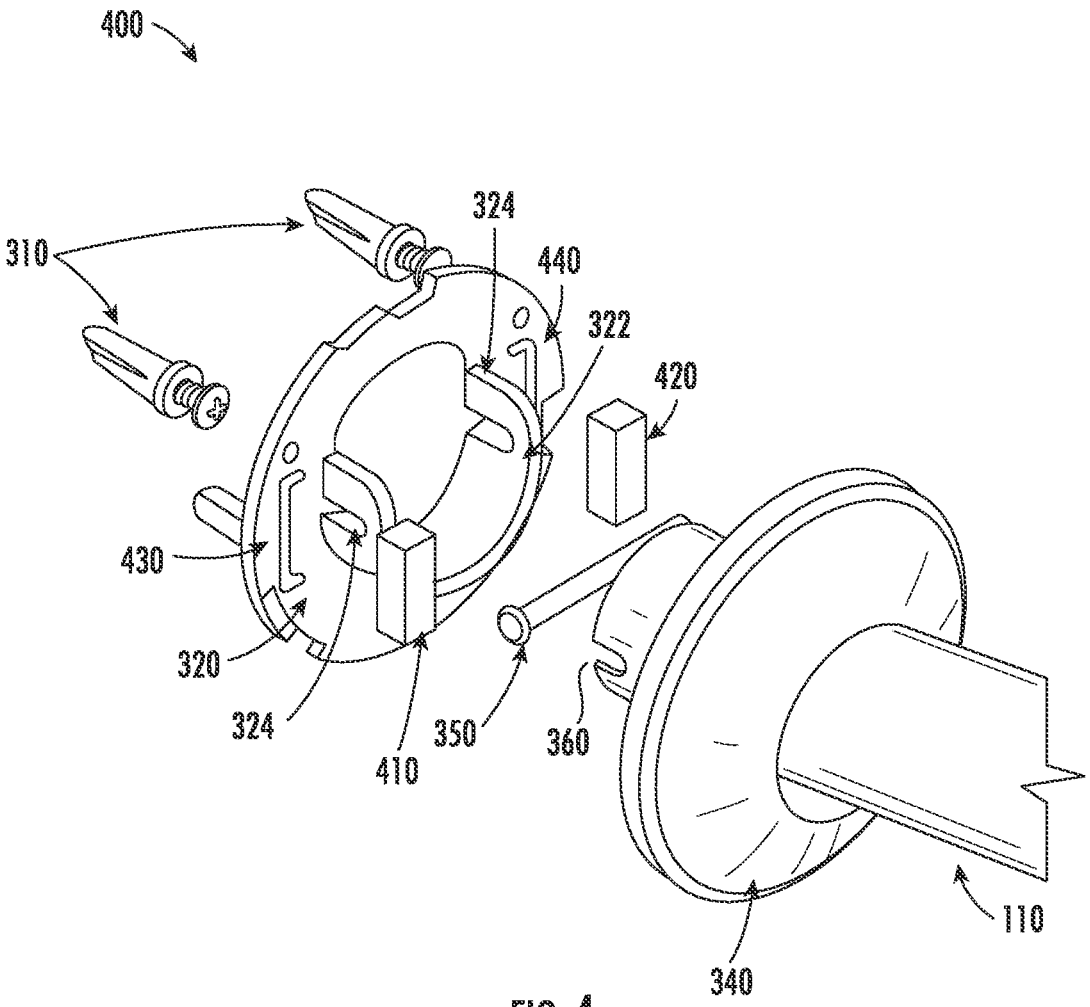
FIG. 4 illustrates a perspective exploded view 400 of an alternative configuration of the retainer illustrated in FIG. 2, in accordance with some embodiments of the invention.

FIG. 4 illustrates a perspective exploded view 400 of an alternate configuration of the retainer 120, in accordance with embodiments of the present invention. In this configuration of the retainer 120, the intermediate gasket 330 of the configuration depicted in FIG. 3 is replaced by a set of blocks (410 and 420) for holding the pin 350 in position and to prevent it from slipping. Furthermore, the at least one circular protrusion of the previously described configuration is replaced by a set of protrusions 430 and 440 extending radially outward from the base 320, where the set of protrusions are configured to hold the set of blocks 410 and 420 in position. The set of protrusions 430 and 440 are designed to match the shape of the set of blocks 410 and 420.

FIGS. 5A-5C illustrate the base 320 of the retainer 120 illustrated in FIG. 4, in accordance with some embodiments of the present invention. In particular, FIG. 5A illustrates a perspective view 500A of the base 320 of the retainer, in accordance with some embodiments of the invention. The base 320 illustrated in FIGS. 5A-5C comprises perforations 508, 509, and 510, where the fasteners 325 (shown in FIG. 3 and FIG. 4) pass through the perforations 508, 509, and 510 and the anchors 310 to mount the base 320 to one of the intersecting walls. FIG. 5B illustrates a back side view 500B of the base of the retainer illustrated in FIG. 5A, in accordance with some embodiments of the invention. The base 320 typically comprises a first set of interlocking members 512, 513, and 514 for interlocking the base 320 and the shroud 340. In other embodiments, alternative locking mechanisms may be used to connect the base 320 and the shroud 340. FIG. 5C illustrates a front side view 500C of the base of the retainer illustrated in FIG. 5A, in accordance with some embodiments of the invention. As shown, the base comprises the set of protrusions 430 and 440 extending radially outward from the base 320, where the set of protrusions are configured to hold the set of blocks 410 and 420 in position. In some embodiments, where the base 320 of the retainer comprises the intermediate gasket 330 as illustrated in FIG. 3, the set of protrusions 430 and 440 may be designed to match the shape of the intermediate gasket.

Figure 6A:
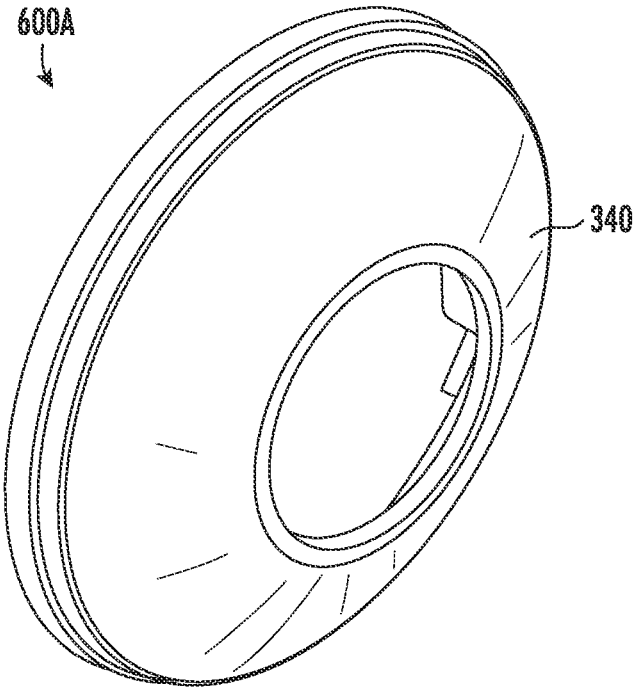
FIG. 6A illustrates a perspective view 600A of a shroud covering the base of the retainer, in accordance with some embodiments of the invention.
Figure 6B:
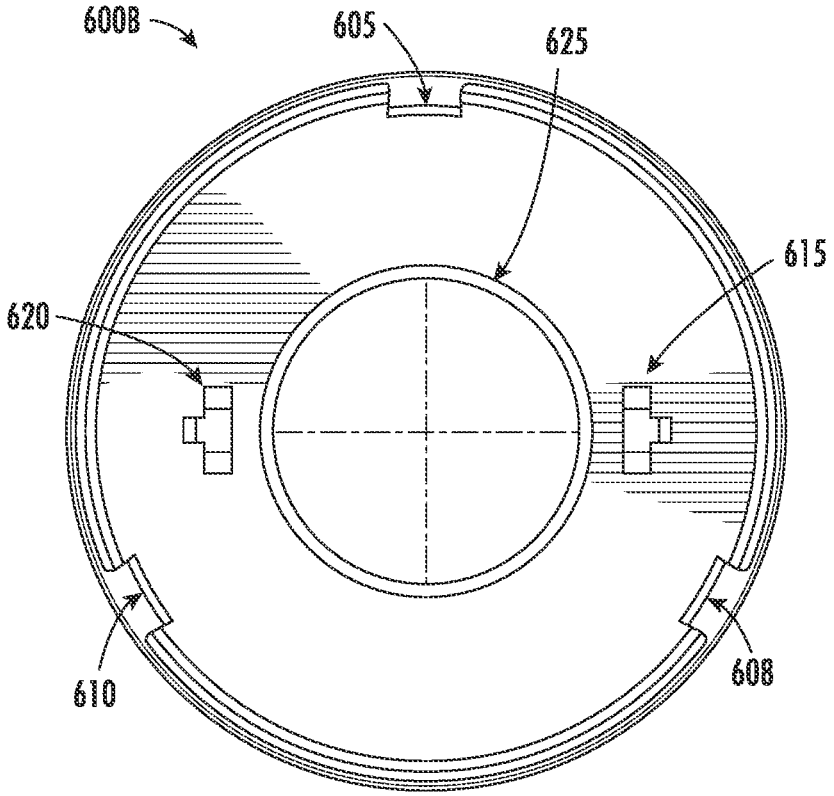
FIG. 6B illustrates a back side view 600B of the shroud illustrated in FIG. 6A, in accordance with some embodiments of the invention.
Figure 6C:
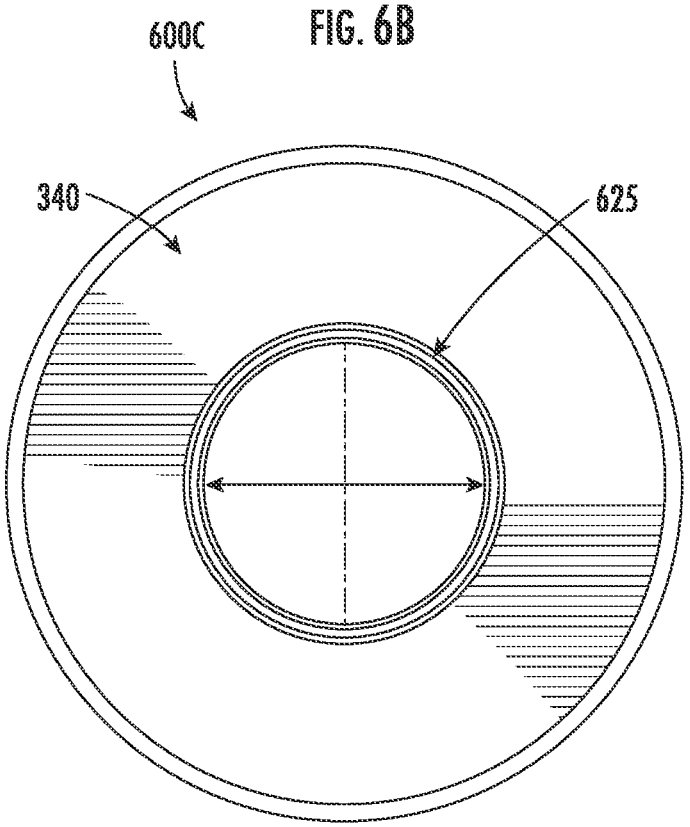
FIG. 6C illustrates a front side view 600C of the shroud illustrated in FIG. 6A, in accordance with some embodiments of the invention.

FIGS. 6A-6C illustrate a shroud which covers the base of the retainer. In particular, FIG. 6A illustrates a perspective view 600A of the shroud 340 covering the base 320 of the retainer, in accordance with some embodiments of the invention. FIG. 6B illustrates a back side view 600B of the shroud illustrated in FIG. 6A, in accordance with some embodiments of the invention. FIG. 6C illustrates a front side view 600C of the shroud illustrated in FIG. 6A, in accordance with some embodiments of the invention. As shown, the shroud 340 may be a concave cover which covers the base 320 of the retainer, where the diameter of the shroud 340 is equal to the diameter of the base 320. In other embodiments, the shape of the shroud 340 may be relative to the shape of the base 320. The shroud 340 comprises a second set of interlocking members 605, 608, and 610 which engage with the first set of interlocking members 512, 513, and 514 (shown in FIG. 5B) of the base 320, thereby connecting the base 320 and the shroud 340. In alternative embodiments, any of the appropriate locking mechanisms may be used to connect the base 320 and shroud 340. The shroud 340 further comprises a first retaining member 615 and a second retaining member 620 on an interior surface of the shroud 340 configured to retain the pin in the holes of the flange 322 and to retain the intermediate gasket 330. The shroud 340 further comprises a bore 625 for receiving an end of the rod 110.

Figure 7:
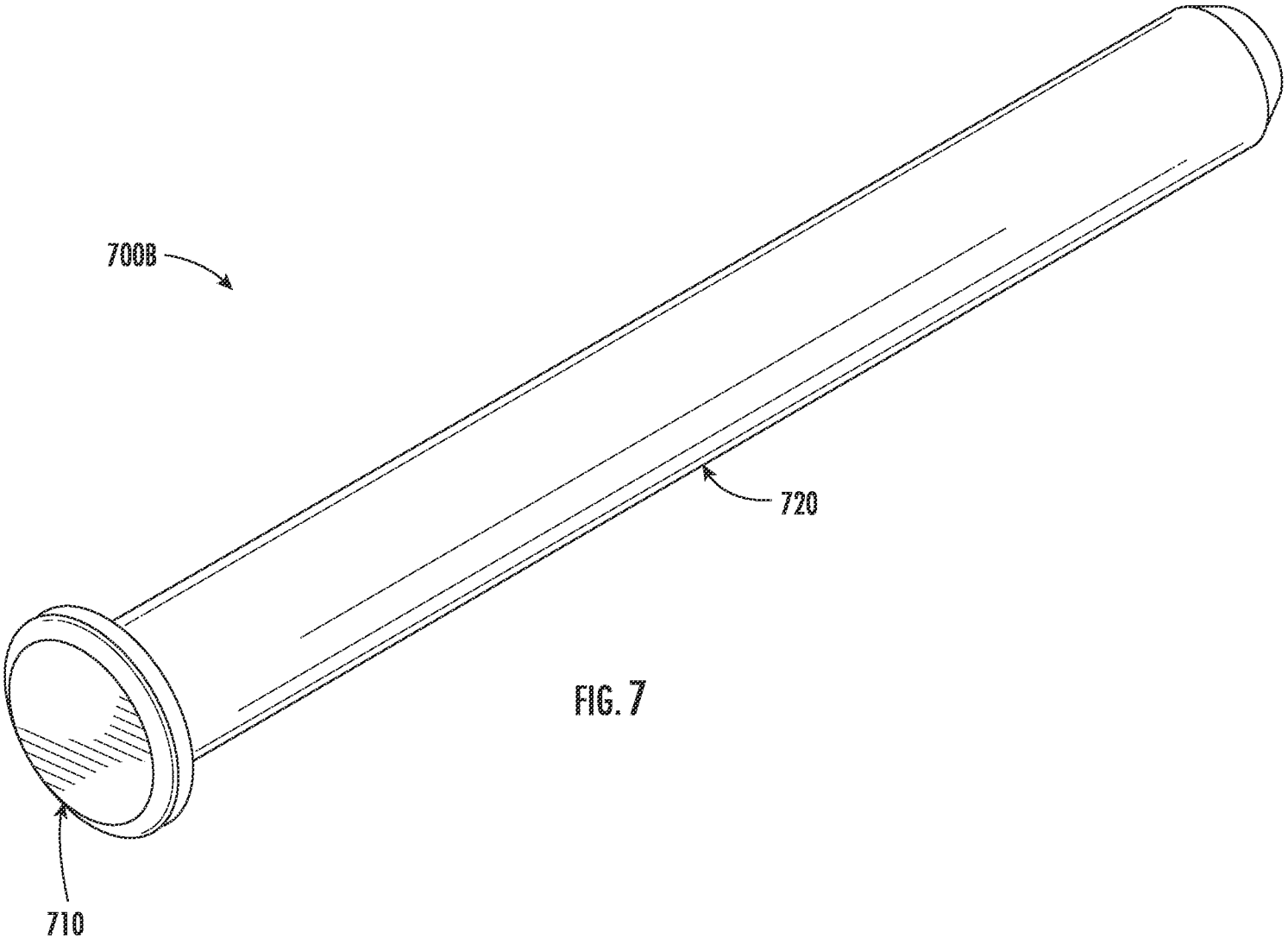
FIG. 7 illustrates a perspective view 700 of a pin, in accordance with some embodiments of the invention.

FIG. 7 illustrates a perspective view 700 of the pin 350, in accordance with some embodiments of the invention. The pin 350 comprises a head 710 and a shank 720, where the diameter of the head 710 is greater than the diameter of the holes in the flange 322 and the holes or notches in the rod 110. The length of the shank 720 is greater than the diameter of the rod 110 and the diameter of the semicircular plate of the flange 322. The length of the shank 720 is less than the diameter of the intermediate gasket 330 shown in FIG. 3.

The corner wall mountable hanging structure shown in FIG. 1 comprises a tubular rod 110 and retainers 120, 130 configured to mount the tubular rod 110. In some embodiments, the tubular rod 110 may be hollow. In other embodiments, the tubular rod 110 may not be hollow. The rod 110 may be made with any type of material (e.g., steel or aluminum). The components of the retainers may be made with a combination of materials (e.g., steel, rubber, aluminum, or the like). For example, the base 320 may be made with aluminum, the intermediate gasket 330 may be made with elastic material or expanded polystyrene, the pin 350 may be made with steel, and the shroud may be made with stainless steel. In some embodiments, the rod of the corner wall mountable hanging structure may have a non-circular cross section. In such embodiments, the retainers may be designed with the same features and components as described above, but may differ in shape to accommodate the non-circular cross section of the rod. In some embodiments, the rod of the corner wall mountable hanging structure may be hollow. In some other embodiments, the rod of the corner wall mountable hanging structure may not be hollow.

Figure 8:
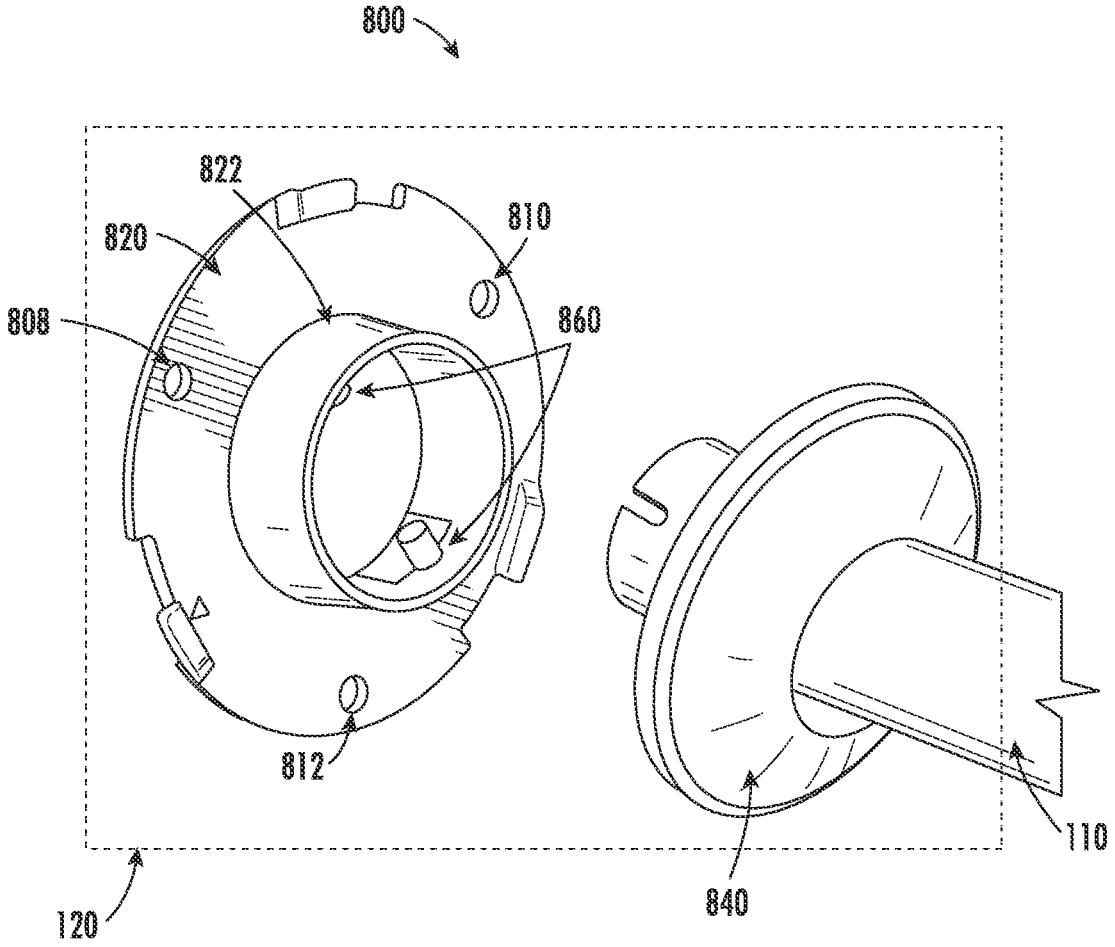
FIG. 8 illustrates a perspective exploded view 800 of an alternative configuration of the retainer illustrated in FIG. 2, in accordance with some embodiments of the invention.

FIG. 8 illustrates a perspective exploded view 800 of an alternative configuration of the retainer 120, in accordance with some embodiments of the present invention. The retainer 120 shown in FIGS. 8, 9A-9C, and 10A-10C may have substantially the same configuration as the retainer shown in FIG. 3-7 except for the features described below. In this configuration, the outer circumference and the inner circumference of the ring of the base 820 may be circular (as illustrated in FIGS. 9A-9C). Furthermore, in this configuration, as shown, a flange 822 may extend from the base 820 for receiving a respective end of the rod, where the flange 822 may comprise a circular plate extending substantially perpendicular from a side of the base 820. As shown, the flange 822 may comprise one or more holding members for holding the rod 110. As shown in FIG. 8, the one or more holding members are at least two projections 860, where the at least two projections 860 slide into or otherwise engage the holes or notches 360 in the ends of the rod 110 to mount the rod 110 to the base 820. The engagement of the at least two projections 860 with the holes or notches 360 in the ends of the rod 110 also help to prevent the rod 110 from rotating relative to the base 820. In this configuration, the shroud 840 does not contain the first retaining member 615 and the second retaining member 620 present in the shroud 340 as shown in FIG. 6C.

FIGS. 9A-9C illustrate a base of the retainer illustrated in FIG. 8, in accordance with embodiments of the present invention. In particular, FIG. 9A illustrates a perspective view 900A of the base 820 of the retainer, in accordance with some embodiments of the invention. As shown, the base 820 comprises perforations 908, 909, and 910, where the fasteners 325 (shown in FIG. 3, FIG. 4, and FIG. 5) pass through the perforations 808, 809, and 810 and the anchors 310 to mount the base 820 to one of the intersecting walls. FIG. 9B illustrates a back side view 900B of the base of the retainer illustrated in FIG. 9A, in accordance with some embodiments of the invention. The base 820 comprises a first set of interlocking members 912, 913, and 914 for interlocking the base 820 and the shroud 840. In other embodiments, alternative locking mechanisms may be used to connect the base 820 and the shroud 840. FIG. 9B illustrates the at least two projections 860 of the base 820 to receive the notches of the rod. FIG. 9C illustrates a front side view 900C of the base of the retainer illustrated in FIG. 5A, in accordance with some embodiments of the invention. As shown, the base 820 comprises a circular flange 822 comprising at least two projections 860.

Figure 10A:
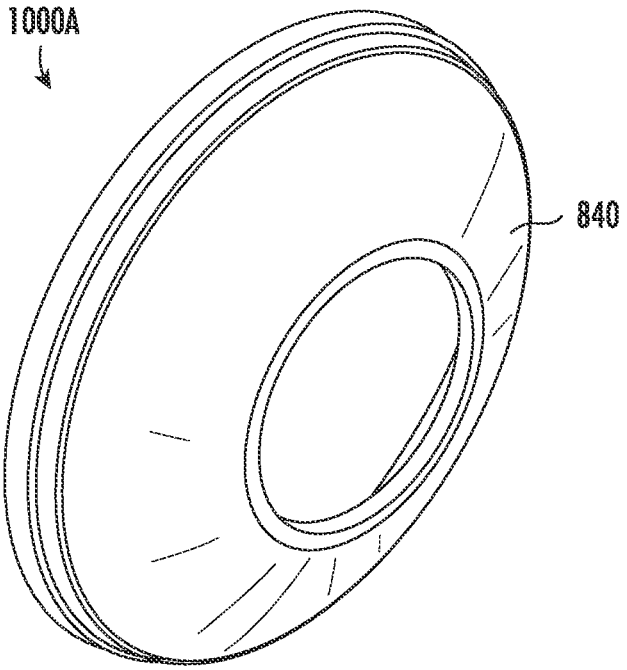
FIG. 10A illustrates a perspective view 1000A of a shroud covering the base of the retainer, in accordance with some embodiments of the invention.
Figure 10B:
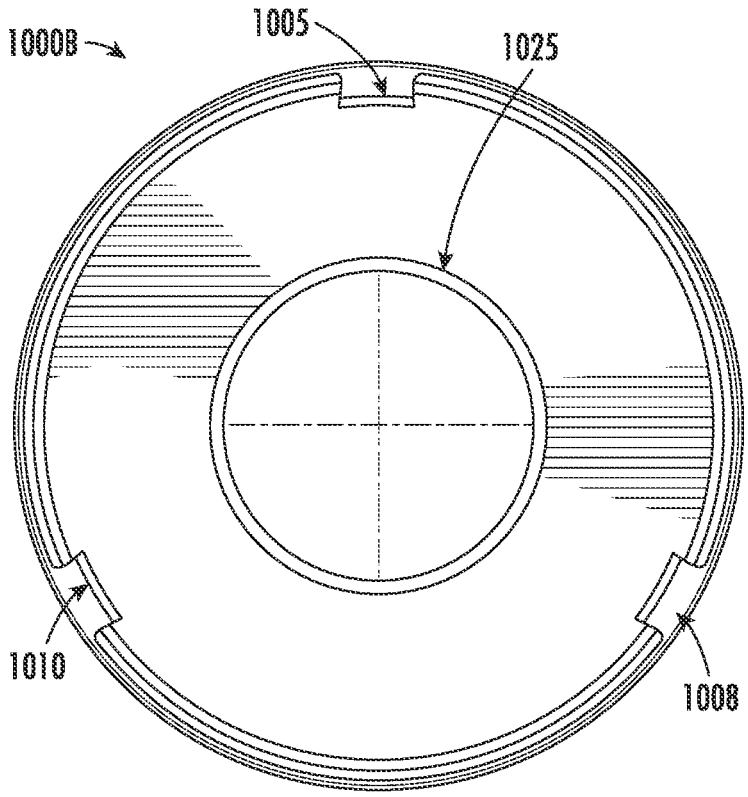
FIG. 10B illustrates a back side view 1000B of the shroud illustrated in FIG. 10A, in accordance with some embodiments of the invention.
Figure 10C:
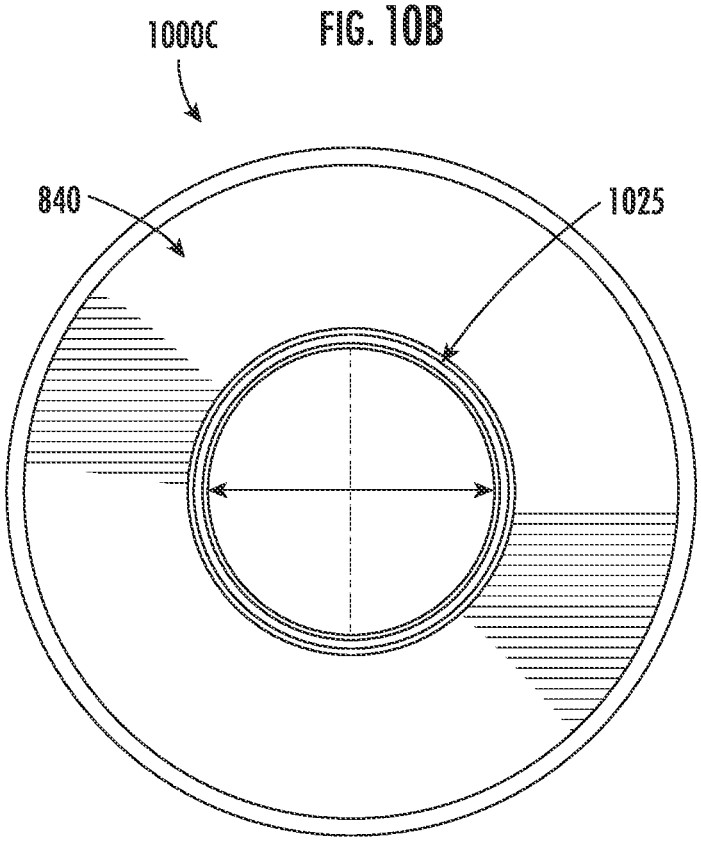
FIG. 10C illustrates a front side view 1000C of the shroud illustrated in FIG. 10A, in accordance with some embodiments of the invention.

FIGS. 10A-10C illustrate a shroud which covers the base of the retainer. In particular, FIG. 10A illustrates a perspective view 1000A of the shroud 840 covering the base 820 of the retainer, in accordance with some embodiments of the invention. FIG. 10B illustrates a back side view 1000B of the shroud illustrated in FIG. 10A, in accordance with some embodiments of the invention. FIG. 10C illustrates a front side view 1000C of the shroud illustrated in FIG. 10A, in accordance with some embodiments of the invention. As shown, the shroud 840 is a concave cover which covers the base 820 of the retainer, where the diameter of the shroud 840 is equal to the diameter of the base 820. In other embodiments, the shape of the shroud 840 may be relative to the shape of the base 820. The shroud 840 comprises a second set of interlocking members 1005, 1008, and 1010 which engage with the first set of interlocking members 912, 913, and 914 (shown in FIG. 9B) of the base 820, thereby connecting the base 820 and the shroud 840. In alternative embodiments, any of the appropriate locking mechanisms may be used to connect the base 820 and shroud 840. The shroud 840 further comprises a bore 1025 for receiving the rod 110.

FIG. 3, FIG. 4, and FIG. 8 also illustrate a method of assembly of the corner wall mountable hanging structure. The bases of both the retainers 120 and 130 are mounted to each of the intersecting walls using fasteners 325 and anchors 310 In some embodiments, both the bases may be mounted to each of the intersecting walls at points 'A' and 'B', where the points 'A' and 'B' are equidistant from a point of intersection of the intersecting walls. In some embodiments, both the bases may be mounted to each of the intersecting walls at points 'X' and 'Y', where the points 'X' and 'Y' are not equidistant from the point of intersection of the intersecting walls. Typically, the bases of the retainers 120 and 130 are mounted at equidistant points from the point of intersection. For the configurations shown in FIG. 3 and FIG. 4, the pin 350 in each of the bases is placed in the through holes 324 of the flanges and an intermediate gasket 330 or a set of blocks 410 and 420 are then attached to each of the bases to hold the pin 350 in position and prevent the pin 350 from slipping. In some embodiments, where the intermediate gasket 330 is made with expandable material and the back side of the intermediate gasket 330 is permanently attached to each of the bases, the two pins are placed in the through holes of the flanges by expanding front side of the intermediate gasket on each of the bases. A first shroud 340 and a second shroud are placed on either ends of the rod 110 and the notches on either ends of the rod 110 are then placed on the pins which are now attached to each of the bases. In an embodiment, where the ends of the rod 110 comprise one or more holes instead of notches, the rod 110 is placed in a position such that the pin 350 passes through the one or more holes on the ends of the rod 110 and the through holes 324 present on the flanges. The first shroud and second shroud are then coupled to the bases using the first set of interlocking members 512, 513, and 514 and the second set of interlocking members 605, 608, and 610, thereby mounting the rod 110. The pin 350 prevents the rod 110 from slipping or rotating relative to the base. For the configuration shown in FIG. 8, the first shroud and the second shroud are placed on either ends of the rod 110 and the projections on the flanges of each of the bases are placed in the notches present on either ends of the rod. The projections on the flanges prevent the rod from slipping or rotating relative to the base. The first shroud and the second shroud are then coupled to the bases using the first set of interlocking members 912, 913, and 914 and the second set of interlocking members 1005, 1008, and 1010, thereby mounting the rod.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation. In addition, where possible, any terms expressed in the singular form herein are meant to also include the plural form and/or vice versa. As used herein, "at least one" shall mean "one or more" and these phrases are intended to be interchangeable. Accordingly, the terms "a" and/or "an" shall mean "at least one" or "one or more," even though the phrase "one or more" or "at least one" is also used herein.

What is claimed:

1. A mountable hanging structure, the hanging structure comprising:

a rod comprising a body with a curved section extending between first and second ends of the rod, wherein each of the first and second ends of the rod comprises one or more holes or notches in the body of the rod;

a mounting assembly comprising two retainers, each retainer comprising at least:

a base; and a flange extending from the base for receiving a respective end of the rod, wherein the flange comprises one or more holding elements configured to engage the corresponding one or more holes or notches in the body of the rod;

wherein each flange comprises a plate extending substantially perpendicular from a side of each base respectively, wherein the one or more holding elements are cantilevered from and permanently fixed to an interior surface of the plate to extend inwardly therefrom;

wherein the mountable hanging structure is configured to be connected between two intersecting walls forming a corner, wherein each base is configured to mount to one of the intersecting walls.

2. The mountable hanging structure of claim 1, wherein the one or more holding elements of each flange comprise at least two projections extending inwardly from each plate respectively.

3. The mountable hanging structure of claim 2, wherein the at least two projections of each plate are configured to fit in the one or more holes or notches in the ends of the rod to thereby at least prevent the rod from rotating relative to the bases.

4. The mountable hanging structure of claim 1, wherein each of the retainers of the mounting assembly further comprises a shroud configured for connecting to each base, each shroud comprising a bore for receiving an end of the rod.

5. The mountable hanging structure of claim 4, wherein each base and each shroud comprise interlocking members for interlocking the shrouds to the bases thereby mounting the rod.

6. The mountable hanging structure of claim 1, wherein the curved section of the rod has a radius of curvature of between about 250 millimeters and 400 millimeters.

7. The mountable hanging structure of claim 1, wherein the curved section of the rod has a radius of curvature of between about 300 millimeters and 350 millimeters.

8. A mountable hanging structure, the hanging structure comprising:

a rod comprising a body with a curved section extending between first and second ends of the rod, wherein each of the first and second ends of the rod comprises one or more holes or notches in the body of the rod;

a mounting assembly comprising two retainers, each retainer comprising at least:

a base;

a flange extending from the base for receiving a respective end of the rod, wherein the flange comprises a circular plate extending substantially perpendicular from a side of the base, wherein the plate comprises first and second projections that are permanently fixed to the plate and extend inwardly therefrom respectively in a cantilevered manner to engage the one or more holes or notches in the body of the rod; and a shroud comprising a bore for receiving an end of the rod, wherein the shroud is configured to engage with the base to mount the rod, wherein the mountable hanging structure is configured to be connected between two intersecting walls forming a corner, wherein each base is configured to mount to one of the intersecting walls.

9. The mountable hanging structure of claim 8, wherein the first projection and the second projection of each retainer are located on opposing sides of each plate respectively.

10. The mountable hanging structure of claim 8, wherein the curved section of the rod has a radius of curvature of between about 250 millimeters and 400 millimeters.

11. The mountable hanging structure of claim 8, wherein the curved section of the rod has a radius of curvature of between about 300 millimeters and 350 millimeters.

* * * * *